US005555592A

United States Patent [19]

Crego

[11] Patent Number: 5,555,592

[45] Date of Patent: Sep. 17, 1996

[54] PAINT-CAN CHANNEL CLEANER AND RECYCLER

[76] Inventor: Charles R. Crego, 6928 Essex Dr. SW., Ft. Meyers, Fla. 33919

[21] Appl. No.: 350,625

[22] Filed: Dec. 7, 1994

[51] Int. Cl.[6] ..... B44D 3/16

[52] U.S. Cl. ..... 15/236.07; 15/236.01; 15/236.09; 15/104.8; D32/49

[58] Field of Search ..... 15/104.8, 236.01, 15/236.05, 236.06, 236.07, 236.08, 236.09; D32/46, 49

[56] References Cited

U.S. PATENT DOCUMENTS

| | | | |
|---|---|---|---|
| D. 243,312 | 2/1977 | Chaney | D32/46 |
| 2,524,116 | 10/1950 | Rein | 15/236.07 |
| 2,860,858 | 11/1958 | Kurs | 15/236.09 |
| 3,080,593 | 3/1963 | Wilson | 15/236.07 |
| 3,267,506 | 8/1966 | Van Patten | 15/236.07 |
| 3,551,937 | 1/1971 | Nelson | 15/236.08 |
| 3,604,047 | 9/1971 | Hennigan | 15/236.09 |
| 4,553,279 | 11/1985 | Gassew et al. | 15/236.06 |
| 4,628,563 | 12/1986 | Kramer | 15/236.01 |
| 4,930,177 | 6/1990 | Rastutis | 15/236.05 |
| 4,982,471 | 1/1991 | Bannan | 15/236.05 |

FOREIGN PATENT DOCUMENTS

| | | | |
|---|---|---|---|
| 3724007 | 2/1989 | Germany | 15/236.01 |
| 14606 | 8/1897 | United Kingdom | 15/236.01 |

*Primary Examiner*—Mark Spisich
*Attorney, Agent, or Firm*—Clifford A. Poff

[57] ABSTRACT

A cleaning device for scooping the paint left over in the channel or groove of a can of liquid paint by previous uses of the can, and for returning the collected paint, back to the interior of the can, while the device is pushed around the can to effect both the scooping action on the liquid paint and the deflecting action of the liquid back to the can. The device has a scooping section, made of stamped material, and having the shape and mold of the groove, so as to present a perfect match with the contour of the groove for effectively scooping the paint, and a deflecting surface for returning the scooped paint back to the interior of the can. It also has a long and flat handle section which is easy to hold. The device is meant to be low cost in manufacture, so as to proliferate in large and inexpensive numbers among paint users, paint shops and paint dealers.

6 Claims, 1 Drawing Sheet

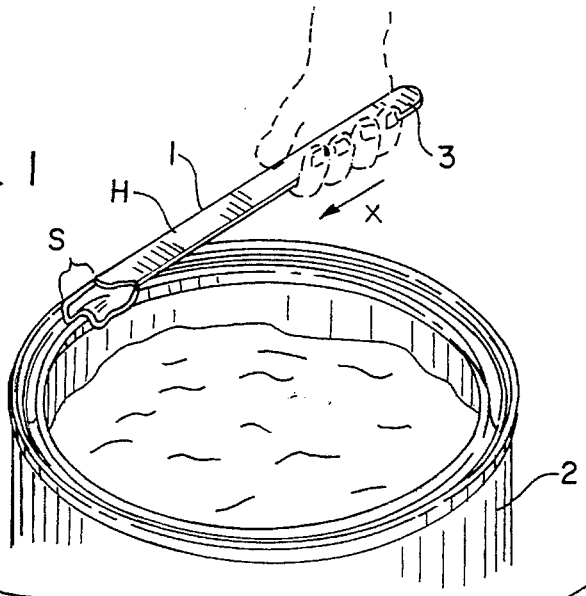
FIG. 1
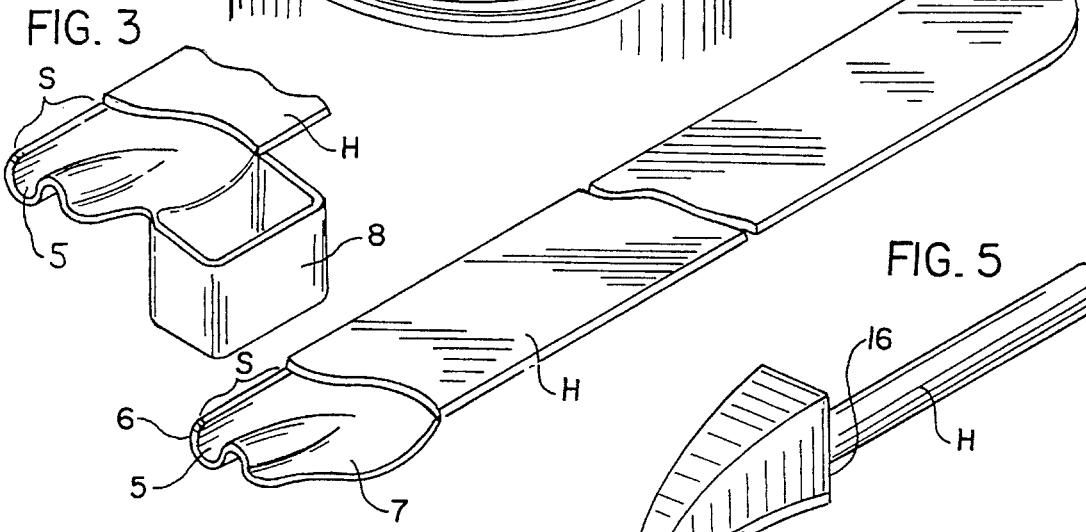
FIG. 3
FIG. 2
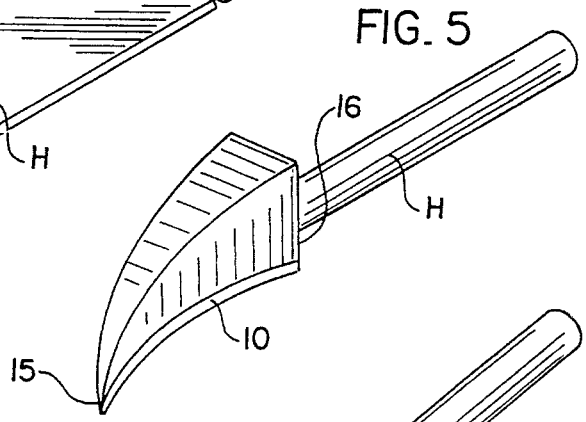
FIG. 5
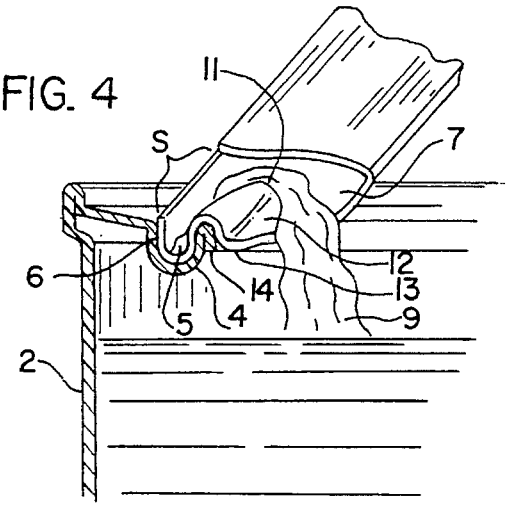
FIG. 4
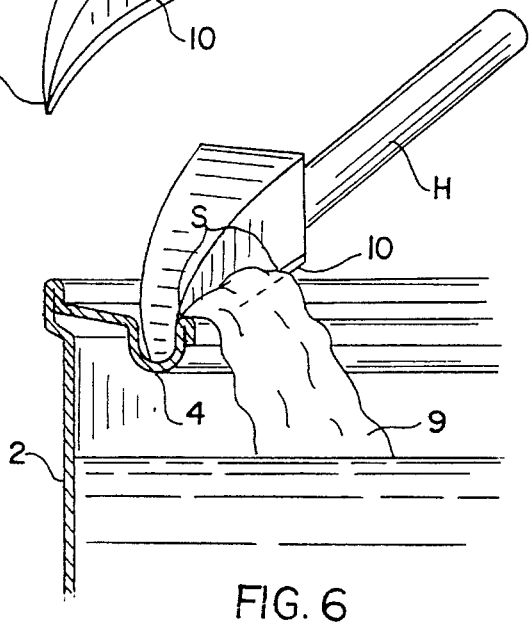
FIG. 6

PAINT-CAN CHANNEL CLEANER AND RECYCLER

BACKGROUND OF THE INVENTION

1. Field of the Invention

The present invention relates to a device for cleaning the channel or groove of a can of paint in general, and for specifically returning the otherwise wasted paint thus collected by the device to the can from which the paint was extracted, thereby reducing losses of paint while performing the duties of painting objects.

The one-gallon can of paint, of stain, or of other chemicals or compounds (hereafter called the paint) is typically built with a groove collecting the residual paint which results from the action of extracting the paint from the can, or from pouring the paint from one can to another. In almost all cases, the groove, used for tight sealing the can with the lid, becomes filled with paint drippings, resulting in a need for cleaning the paint and for returning it to the can, thereby reducing losses of liquid paint. The difficulties which follow when the groove is not cleaned involve not only the loss of paint, but also the drying, caking and shrinking of paint, thereby affecting the sealing of the can after use, and further contaminating the paint remaining in the can, against future use. In addition, water from the liquid paint can react with the lid to oxidize it and to contaminate the remaining paint with undesirable oxides.

The purpose of my invention is to prevent these effects, and to minimize paint losses, but in a way that is inexpensive and easy to effect.

Thus, it can be seen that the potential fields of use for this invention are manifold, and the particular preferred embodiment described herein is in no way meant to limit the use of the invention to the particular field chosen for exposition of the details of the invention.

A comprehensive listing of all the possible fields to which this invention may be applied is limited only by the imagination, and is therefore not provided herein. Some of the more obvious applications are mentioned herein in the interest of providing a full and complete disclosure of the unique properties of this device, previously unknown in its proposed shape and dimension. It is to be understood from the outset that the scope of this invention is not limited to the applications mentioned below or to the specific examples of potential uses presented hereinafter.

2. Description of the Prior Art

Devices for scraping paint are old and well known in the art. Several such devices have been developed in the past, but none in the form of a device such as the one proposed by the present invention. In this day, where recycling is becoming more and more important, and where waste and loss of paint must be minimized, if not eliminated, it has become an urgent task to design devices or apparatus capable of reducing losses of paint due to dripping of the paint brush, to rubbing the paint brush against to top rim of the can from which it is extracted, or also due to pouring paint from one can to another, to name but a few of many applications. The following known prior art has been directed to provide scrapers for removing the said paint, but none offers the savings involved in returning the excess paint off the top of a can and returning the paint to the can from where it came from, except one, as shown in the narrative below, and this exception is not as effective and low-cost as the one proposed in the present invention. As will be seen, the simplicity and effectiveness of my invention is finally not rivaled in the prior art.

U.S. Pat. No. 1,235,038, issued to Lucie M. Klinka on Jul. 31, 1917, discloses a kitchen utensil made with a long shank and a flat end, and designed to scrape pots and pans in the kitchen. In contrast to our proposed invention, it does not offer an extension to scoop the paint off of a can of paint. The present invention is specifically designed to scoop the paint, to save the paint thus collected, and return it to the can from where it came. There is no obvious extension in the patented device to scoop paint with such a device, in the way proposed by the invention described herein.

U.S. Pat. No. 1,643,336, issued to Sylvester P. Frost on Sep. 27, 1927, offers a scraper device made to be borne by a thumb, by a suitable ring bracing the thumb. Our invention proposes a scooping device which is not borne by a thumb, and which consequently does not tire the thumb by performing a job the thumb cannot easily do. The patented device is therefore far removed from the task our present invention addresses.

U.S. Pat. No. 2,860,858, issued to Abraham Kurs on Nov. 18, 1958, offers a stirring-mixing combination device which can be used to scrape paint off of surfaces and brushes, but which is not shaped to go deep down into the groove of can of paint for the purpose of scooping the paint. On the contrary, it is made of a flat surface, while this invention discloses the feature of a curved surface for going deep down into the groove of a paint can.

U.S. Pat. No. 3,604,047, issued to Edward A. Hennigan on Sep. 14, 1971, is the concept closest to the present invention. It offers a device for removing liquid paint from the circular groove of a standard cylindrical can of paint, and for returning the paint to the interior of the can. The device proposed in said patent would extend a blade into the said groove, said blade would scoop the paint from the groove, and would discharge it into the can. It is made to ride against the rim of the can and be pushed by hand to effect the scooping action. It is not described, nor is it obvious, how the pushing action will be performed, one can presume that it is to be done by a push of the thumb, or by a push of the palm of the hand, or both, but no idea of a handle is offered in said patent.

In contrast to the present invention, the Hennigan patented device is bulky and made of one plastic piece, but with several surfaces performing different roles. One surface is to serve as a guide around the outer circumference of the can, as mentioned above in regards to riding against the rim of the can. A second surface is to scoop the paint off the groove in which the paint is trapped, and for returning said paint to the can, while a third surface is to scrape the remaining flat portion of the perimeter around the can and to deflect the paint into the groove, prior to it being removed by the aforementioned second surface. Because of its short dimension above the can, and its lack of a proper handle, the patented device offers no protection to the hand that pushes it around the perimeter, so that the hand may end up being splashed with paint as it pushes the device. The absence of a dedicated handle makes it hard for the hand to apply the right amount of pressure on the device as it is pushed around the rim of the can. Furthermore, the patented device must be dimensionally matched to the radius of the can, so that a can of one dimension can be serviced by only one dimensioned device, or otherwise the device must be made into several dimensions to fit the various sizes of cans popularly available from paint stores. From the multiplicity of surfaces making up the patented device, it can be inferred that it may not be easily machined. Indeed, it is a truly three-dimensional device, as opposed to the present invention, which can be fabricated by stamping a sheet metal surface, thereby making our device an almost two-dimensional device in shape.

By contrast, since the present invention is for a device that is made up of only one surface, it is much simpler in design and construction, and is also cheaper to fabricate, it can be made to proliferate in large numbers among users, paint shops and paint dealers. The present invention is very close to the ubiquitous paint stick used by paint users to stir the paint in the can prior to dipping the paint brush in the can, as is normally done in order to obtain a paint having uniform color and texture. The present invention is to be made of one surface, although stamped to give it the shape of a scoop, and is adapted to the dimensions of grooves normally encountered in every can of paint of any dimension, as can be seen from the description of the invention offered below, where the scoop is made to match the shape of the groove where the paint is trapped around the circumference of the can. The present device acts as its own handle, because it is long and flat in design and construction, and therefore does not present the problem of paint splashing the hand while moving the device around the groove. In other words, keeping the hand a distance away from the scooping action helps reduce the chances of paint splashing. To sum up the findings relating to the already patented device, as contrasted with the present invention, it can be said that the present invention offers a device which is considerably improved in a non-obvious manner over the prior patented one.

A multi-purpose paint stick is offered by U.S. Pat. No. 4,553,279, issued to Gary L. Gassew et al. on Nov. 19, 1985. The paint stick serves several types of applications relating to painting articles, and is also made into a flat stick, but is not specifically envisioned to go into the groove of a can of paint, as is the present invention.

U.S. Pat. No. 4,628,563, issued to John H. Kramer on Dec. 16, 1986, discloses a paint can rim and lid scraper. This device would be similar to that disclosed in the present application, were it not for the fact that it is not meant to scoop paint off the groove of a paint can and to return the paint to the can in the manner taught in the present application. The Kramer device is, indeed, a scraper, but not much else.

U.S. Pat. No. 4,930,177, issued to John F. Rastutis on Jun. 5, 1990, is for another scraper of paint to work around a can of paint, which again does not purport to scoop and save the amount of paint trapped in the groove around a can of paint, as in the present invention.

Finally, U.S. Pat. No. 4,982,471, issued to John A. Bannan on Jan. 8, 1991, discloses a multi-use paint tool, which scrapes the paint off of a groove around a can of paint, but does not scoop the paint and does not return it to the can, as in the present invention.

None of the above inventions and patents, taken either singly or in combination, are seen to describe the present invention as claimed.

SUMMARY OF THE INVENTION

Briefly, the invention comprises a single piece of material, stamped from sheet metal or formed by a plastic injecting molding process, with curved portions to match the contour of the rim of a can and its groove, and including a scooping section, with a paint deflector. The scooping section is shaped to match the shape of the groove on top of the can. The paint deflector is similar in shape to a snow removal deflector, but of course much smaller in scale. The handle portion of the device is an extension that provides a means for conveniently holding the device, without straining the hand.

Another variant of the device, no longer completely flat, has a small paint-receiving reservoir attached to it and designed to capture the paint scooped from the groove.

An extension of the original device, such as is described above, can be made to provide a scraping and scooping action, with a blade having a pointed wedge to fit the groove.

Accordingly, it is the principal object of the invention to provide a new and improved paint channel cleaner and recycler device which overcomes the disadvantages of the prior art in a simple but effective manner.

It is a major object of this invention to provide a one piece groove cleaner having a curved portion matched to the shape of a groove, with a paint deflector to redirect the flow of excess paint accumulated in the groove back to the can from which it came, thus saving paint losses that would otherwise accrue.

It is another object of the device to provide an extended handle away from the groove section, in order to provide an easy way of holding the device and effecting the cleaning action, away from where the paint has accumulated in the groove, so as not to splash the user with paint resulting from the cleaning action of the device.

It is a further object of the invention to provide a paint scraper and scooper in the form of a wedge, and having a handle for easy pushing the device, and for protecting the hand.

Finally, it is a general goal of the invention to provide improved elements and arrangements thereof in a device for the purposes described which is inexpensive, dependable and fully effective in accomplishing its intended purposes.

These and other objects of the present invention will become readily apparent upon further review of the following specifications and drawings.

The present invention meets or exceeds all the above objects and goals. Upon further study of the specifications and appended claims, further objects and advantages of this invention will become apparent to those skilled in the art.

BRIEF DESCRIPTION OF THE DRAWINGS

The present invention will be more fully understood when the following description is read in light of the accompanying drawings in which:

FIG. 1 is an environmental perspective view of the first embodiment of the invention, shown in action around the perimeter of a standard can of paint.

FIG. 2 is a view of the groove cleaner and recycler made from a single piece of sheet metal.

FIG. 3 is a variant of the device showing a small container integrally formed with and along one edge of, but which may be made separable from and attachable to, the main part of the device, and capable of receiving the paint thus scooped from the groove.

FIG. 4 shows the scooping device in action, with paint flowing from the groove and back into the can.

FIG. 5 shows another embodiment of a device made for scraping, and wedge-shaped with a pointed end.

FIG. 6 shows the device of FIG. 5 in use with the paint being returned to the can.

DETAILED DESCRIPTION OF THE PREFERRED EMBODIMENTS

The paint-channel cleaner and recycler invention is generally designated 1 in FIG. 1 and is to be understood to comprise the following main sections: the scooping section, designated S in FIGS. 1 through 6, and a handle section, designated H in FIGS. 1, 2, 5 and 6. The paint channel cleaner and recycler can be made of a single piece of material, stamped from sheet metal or formed by a plastic injecting molding process.

FIG. 1 shows a preferred embodiment of the cleaner and recycler device 1 according to the present invention in action around the rim of a can 2 of paint. It shows the long and convenient handle 3 for holding the device while performing the scooping action. At the bottom end, shown in more detail in FIG. 2, is the scooping section S having scoop S shaped to match the shape of a groove 4. As shown in FIGS. 1–4, the scoop 5 has an elongated length for operating in the channel of the paint can rim. Note the scoop 5 and deflector 6, directs the stream of paint to a discharge surface 7 shaped to return the paint back to the can 2. Note also the cleaning and scooping motion of the hand is indicated by arrow X in FIG. 1.

FIG. 3 shows the extra receptacle cup 8 in the scooping section S for receiving the paint scooped and deflected into receptacle cup 8.

FIG. 4 shows the elements 5, 6 and 7 in action with the flow of paint shown discharging the paint sideways at wall surface 11 toward stream 9 into the interior of can 2. As seen in FIG. 4, discharge surface 7 includes an upper surface 12 on which the paint flows toward the interior of can 2 and a lower surface 13 for contacting an inner edge 14 of rim of can 2, the lower surface 13 serving as a guide to keep scooping section S from becoming jammed in lid groove 4.

The wedge-shaped embodiment of the present invention, shown in FIGS. 5 and 6, displays the curved blade 10 having a pointed leading end 15 made to match the groove 4 and a trailer curved end 16 to discharge the recovered paint back to the can 2. As shown in FIGS. 5 and 6, the blade 10 has a convex top surface and a concave bottom surface between opposite first and second sides of which one side forms a concave trailer curved surface.

It is to be understood that the provided illustrative examples are by no means exhaustive of the many possible uses for my invention.

While the present invention has been described in connection with the preferred embodiments of the various figures, it is to be understood that other similar embodiments may be used or modifications and additions may be made to the described embodiment for performing the same function of the present invention without deviating therefrom. Therefore, the present invention should not be limited to any single embodiment, but rather construed in breadth and scope in accordance with the recitation of the appended claims.

I claim:

1. A device for cleaning a lid channel around the upper perimeter of a paint can by scooping the liquid paint left in the lid channel from previous use of the can, and directing the paint towards an interior portion of the can, made of one flat and long piece of material, and comprising:

(a) an elongated curved scooping section including an elongated scoop having a lower surface which is shaped to match the shape and size of the lid channel and an upper surface which defines an elongated groove in said scooping section, said scoop further having first and second sides on opposite sides of said elongated groove, a deflecting surface extending along the first side of said scoop to change the flow of the residual paint created by said scooping section, while it is being scooped by pushing the device around the perimeter of the can, said deflecting surface adapted to direct the paint in a direction toward the interior portion of the can along the length of the elongated scoop, the elongated groove in the scooping section having a width which increases from a free end of the scooping section toward an opposite second end of the scooping section and wherein the wider end thereof is curved toward the interior portion of the can when in use;

(b) a discharging surface extending along the second side of the scoop forming a continuation of the scooping section of the device and serving to help direct the flow of paint from the scooping section towards the interior of the can, the discharging surface being separated from the scoop by a member defining a channel for receiving the inner edge of the rim of the can, there being means at the second end of the scooping section adjacent an end of said member for directing the flow of paint from the scoop to the discharging surface; and (c) a long handle extending from the second end of the scooping section, for holding the device and conveniently pushing around the can in its scooping action.

2. A device, according to claim 1, wherein said discharging surface comprises;

an upper surface for providing a flow path for the paint being directed toward the interior of the can, and a lower surface opposite said upper surface which serves as a lateral guide for the device by sliding on an inner edge of said lid channel, so that said curved scooping section does not jam in said lid channel.

3. A device according to claim 1 wherein said scooping section, discharge surface and handle are made of sheet metal so that the scooping section may be easily stamped to take the shape and size of the channel around the perimeter of the can.

4. A device according to claim 1, wherein the scooping section, discharge surface and handle are plastic so that the scooping section may be easily molded to take the shape and size of the channel around the perimeter of the can.

5. A device for cleaning a lid channel around the upper perimeter of a paint can by scooping the liquid paint left in the lid channel from previous use of the can and directing the paint towards an interior portion of the can, comprising:

(a) an elongated wedge-shaped body having a first end, a second end, a top surface, a bottom surface and opposite first and second sides extending from the first end to the second end between the top and bottom surface, said wedge-shaped body defining a point at said first end thereof for scooping paint located in said channel and which creates a flow of paint from said lid channel, said top surface being convexly curved and the bottom surface being concavely curved and one of said sides defining a concave trailer curved surface for deflecting the flow of paint toward the interior of the can from which it came, the width of said wedge-shaped body at said top surface and said trailer curved surface gradually decreasing from said second end to said first end, said top surface and said concave trailer curved surface being slightly skewed at said first end toward the interior portion of the can when in use, and (b) a handle extending from the second end of said wedge-shaped body for effortless pushing action around the channel, while the device is scooping the paint left over from previous uses of the can.

6. A device for cleaning a lid channel around the upper perimeter of a paint can by scooping the paint left in the lid channel from previous use of the can, and directing the paint towards an interior portion of the can, made of one flat and long piece of material, and comprising:

(a) a curved scooping section including an elongated scoop which is shaped to match the shape and size of such lid channel, said scooping section further including a deflecting surface attached to said scoop to change the flow of such paint while it is being scooped as the device is pushed around the perimeter of such can, said deflecting surface capable of directing such paint in a direction toward the interior portion of such can along the elongated length of said scoop;

(b) a discharging surface, forming a continuation of said scooping section of said device, and serving to direct the flow of such paint from said scooping section toward the interior of such can;

(c) a cup attached to one side of said discharging surface for receiving and holding such paint being removed from such lid channel by the scooping action of said device; and (d) a handle extending from said scooping section for pushing said device in such lid channel so as to remove such paint from such lid channel.

* * * * *